US006114102A

United States Patent [19]

Aylward et al.

[11] Patent Number: 6,114,102

[45] Date of Patent: Sep. 5, 2000

[54] IMAGING SUBSTRATE WITH OXYGEN BARRIER LAYER

[75] Inventors: Peter T. Aylward, Hilton; Ann P. Newberry; John F. Sawyer, both of Fairport; Dennis E. McGee, Penfield; Lyle J. Harley, Newark, all of N.Y.

[73] Assignee: Eastman Kodak Company, Rochester, N.Y.

[21] Appl. No.: 09/178,943

[22] Filed: Oct. 26, 1998

[51] Int. Cl.[7] ..... G03C 1/79; G03C 1/93

[52] U.S. Cl. ..... 430/536; 430/538; 428/315.5; 428/315.9; 428/511; 428/513; 428/514

[58] Field of Search ..... 430/536, 538; 428/315.5, 315.9, 511, 513, 514

[56] References Cited

U.S. PATENT DOCUMENTS

| | | | |
|---|---|---|---|
| 4,187,113 | 2/1980 | Mathews et al. | 430/533 |
| 4,283,486 | 8/1981 | Aono et al. | 430/537 |
| 4,377,616 | 3/1983 | Ashcraft et al. | 428/213 |
| 4,581,267 | 4/1986 | Miller | 428/40 |
| 5,232,825 | 8/1993 | Httori et al. | 430/535 |
| 5,290,671 | 3/1994 | Thomas et al. | 430/536 |
| 5,466,519 | 11/1995 | Shirakura et al. | 428/323 |
| 5,550,282 | 8/1996 | Tsunemi et al. | 560/301 |
| 5,886,282 | 2/1999 | Bourdelais et al. | 430/536 |
| 5,902,720 | 5/1999 | Haydock et al. | 430/536 |

*Primary Examiner*—Richard L. Schilling
*Attorney, Agent, or Firm*—Paul A. Leipold

[57] ABSTRACT

This invention provides an imaging element comprising paper and a biaxially oriented polyolefin sheet adhered to the upper side of said paper, wherein between the paper and the upper surface layer of said biaxially oriented polyolefin sheet, there is located at least one oxygen barrier layer having less than 8.0 $cc/m^{2,}$ hr. atm. oxygen transmission rate.

7 Claims, No Drawings

IMAGING SUBSTRATE WITH OXYGEN BARRIER LAYER

FIELD OF THE INVENTION

This invention relates to formation of laminated substrates for imaging materials. It particularly relates to improved image stability in the presence of light for laminated substrate photographic papers.

BACKGROUND OF THE INVENTION

It has been proposed in U.S. patent application Ser. No. 08/862,708 filed May 23, 1997 to utilize biaxially oriented polyolefin sheet laminated to cellulose photographic grade paper for use as a silver halide color photographic base in order to provide a more effective layer between the photosensitive layers and the base paper, in particular, to more effectively incorporate colorant materials, enhance sharpness, improve gloss, reduce humidity curl, and improve whiteness, as well as provide an improved smooth surface.

This superior invention to traditional photographic support can be further enhanced to reduce discoloration and fading of the silver halide dye image and discoloration of white areas in silver halide color photographic base in the presence of light by the addition of an oxygen barrier to prevent oxygen from being transmitted through the base structure to the dye image and white areas. Such an enhancement in traditional photographic support was addressed in U.S. Pat. No. 5,391,473 (Lacz et al) and U.S. Pat. No. 4,283,486 (Aono et al) where it was taught that oxygen is responsible for discoloration and fading of the silver halide dye image and discoloration of white areas in silver halide color photographic base in the presence of light. In addition, European Patent Application EP 0 803 377 A1 (Ogata et al) discusses the desirability of an oxygen barrier layer for recording applications such as thermal imaging for preventing fade.

The cause of the discoloration and fading of the dye image and discoloration of the white area is considered to be caused mainly by a combination of high intensity light and the presence of oxygen. Therefore techniques for preventing oxygen from coming in contact with the die images for traditional silver halide color photographic structures have been proposed. For example, techniques are described in *Research Disclosure*, No. 15162, page 82 (November 1976), and Japanese Patent Application (OPI) Nos. 11330/74 and 57223/75 wherein an oxygen-shielding layer formed from a substance having a low oxygen permeability is used to cover the dye images.

Therefore, it is desirable to incorporate an oxygen barrier in the biaxially oriented polyolefin sheet laminated to cellulose photographic grade paper for use as a silver halide color photographic base. The teachings listed above for traditional imaging supports help to identify what types of materials could reduce the fade and discoloration problem; however, incorporation of these materials into the biaxially-oriented-polyolefin-sheet-laminated-to-cellulose—photographic-grade-paper structure is not trivial. What remains is a need for an oxygen barrier incorporated into the structure between the paper and the upper surface layer of said biaxially oriented polyolefin sheet, which has no detrimental effect on the robust bond between the oriented sheets and the base paper.

PROBLEM TO BE SOLVED BY THE INVENTION

When a biaxially oriented polyolefin sheet is laminated to cellulose photographic grade paper for use as a silver halide color photographic base, discoloration and fading of dye images, especially in the presence of high-intensity light, may occur. There remains a need for an oxygen barrier incorporated into the structure between the paper and the upper surface layer of said biaxially oriented polyolefin sheet, which has no detrimental effect on the robust bond between the oriented sheets and the base paper.

SUMMARY OF THE INVENTION

An object of the invention is to provide an improved photographic paper.

Another object of this invention is to provide a photographic paper that, when subjected to development processing, produces dye images which are less subject to discoloration and fading.

Another object of this invention is to provide a photographic paper which is improved with respect to the discoloration and fading of dye images, without exhibiting adverse side effects on its photographic properties, product features, or overall product quality.

These and other objects of the invention generally are accomplished by a providing an imaging element comprising paper and a biaxially oriented polyolefin sheet adhered to the upper side of said paper, wherein between the paper and the upper surface layer of said biaxially oriented polyolefin sheet, there is located at least one oxygen barrier layer having less than 8.0 $cc/m^{2}\cdot$ hr. atm oxygen transmission rate.

ADVANTAGEOUS EFFECT OF THE INVENTION

The invention provides an improved base for casting of photosensitive layers. It particularly provides an improved base for high-intensity light stability over time.

DETAILED DESCRIPTION OF THE INVENTION

There are numerous advantages of the invention over prior practices in the art. The invention provides a photographic element that has much less tendency to discolor through the formation of stains in the white areas and reduced fading of the color images. This invention is particularly useful for the prevention of fading of the magenta color images in the presence of high intensity light. In addition, this invention reduces the fading of magenta color images at elevated temperatures. This invention further accomplishes all of these improvements without ill effect to the bond between the said biaxially oriented polymer sheet and said photographic paper base.

These and other advantages will be apparent from the detailed description below. The benefits of the invention generally are accomplished by providing a imaging element comprising a paper base, at least one photosensitive silver halide layer, a layer of biaxially oriented polymer sheet between said paper base and said silver halide layer, and at least one polymer layer between said biaxially oriented polymer sheet and said paper base which binds the two together, wherein between the paper and the opaque layers of said biaxially oriented polyolefin sheet, there is located at least one oxygen barrier layer having less than 8.0 $cc/m^{2}\cdot$ hr atm (20° C., dry state) and preferably no more than 2.0 $cc/m^{2}\cdot$ hr atm (20° C., dry state) oxygen transmission rate as this rate provides the best balance of cost vs benefit. The terms used herein, "bonding layer", "adhesive layer", "tie layer" and "adhesive" mean the melt extruded resin layer used to adhere a biaxially oriented polyolefin sheet to a base such as paper, polyester, fabric, or other suitable material for the viewing of images; "oxygen impermeable layer" and "oxygen barrier layer" refer to the layer having oxygen permeability of not more than 8.0 cc/$m^2$ hr atm (20° C., dry state) according to the method defined in ASTM D-1434-63 when the layer is measured on its own as a discrete sample.

The present invention consists of a multilayer sheet of biaxially oriented polyolefin which is attached to both the top and bottom of a photographic quality paper support by melt extrusion of a polymer tie layer. The terms as used herein, "top", "upper", "emulsion side", and "face" mean the side or towards the side of an imaging member bearing the imaging layers. The terms "bottom", "lower side", and "back" mean the side or towards the side of the imaging member opposite from the side bearing the imaging layers or developed image.

Any suitable biaxially oriented polyolefin sheet may be used for the sheet on the top side of the laminated base used in the invention. Microvoided composite biaxially oriented polyolefin sheets are preferred and are conveniently manufactured by coextrusion of the core and surface layers, followed by biaxially orientation, whereby voids are formed around void-initiating material contained in the core layer. Such composite sheets may be formed as in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\text{ of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 μm, preferably from 20 to 70 μm. Below 20 μm, the microvoided sheets may not be thick enough to minimize any inherent non-planarity in the support and would be more difficult to manufacture. At thickness higher than 70 μm, little improvement in either surface smoothness or mechanical properties are seen, and so there is little justification for the further increase in cost for extra materials.

The biaxially oriented polyolefin top sheets that have been used in this invention may contain a plurality of layers in which at least one of the layers contains voids. The voids provide added opacity to the imaging element. This voided layer can also be used in conjunction with a layer that contains at least one pigment from the group consisting of: $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides additional advantages in the optical performance of the final imaging element. The imaging element may have either a photographic silver halide and dye forming coupler emulsion or an image receiving layer typically used for thermal dye sublimation or ink jet.

"Void" is used herein to mean devoid of added solid and liquid matter, although it is likely the "voids" contain gas. The void-initiating particles which remain in the finished packaging sheet core should be from 0.1 to 10 μm in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus. there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar-C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2-10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads, or inorganic particles such as clay, talc, barium sulfate, and calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is preferred, as it is low in cost and has desirable strength properties.

The non-voided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

By having at least one non-voided skin on the microvoided core, the tensile strength of the sheet is increased and makes it more manufacturable. It allows the sheets to be made at wider widths and higher draw ratios than when sheets are made with all layers voided. Coextruding the layers further simplify the manufacturing process.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 or more layers if desired to achieve some particular desired property.

In a preferred embodiment of the invention, an oxygen barrier layer having less than 8.0 cc/m$^2$ hr. atm. oxygen transmission rate in a post-oriented state is incorporated as a layer into the said biaxially oriented polyolefin sheet through co-extrusion prior to biaxial orientation. Said oxygen impermeable layer comprises at least one member selected from the group consisting of homo- and co-polymers of acrylonitrile, alkyl acrylates such as methyl acrylate, ethyl acrylate, butyl acrylate, alkyl methacrylates such as ethyl methacrylate and methyl methacrylate, methacrylonitrile, alkyl vinyl esters such as vinyl acetate, vinyl propionate, vinyl ethyl butyrate and vinyl phenyl acetate, alkyl vinyl ethers such as methyl vinyl ether, butyl vinyl ether, chloroethyl vinyl ether, vinyl alcohol, vinyl chloride, vinylidene chloride, vinyl fluoride, styrene and vinyl acetate (in the case of copolymers, ethylene and/or propylene can be used as comonomers), cellulose acetates such as diacetyl cellulose and triacetyl cellulose, polyesters such as polyethylene terephthalate, a fluorine resin, polyamide (nylon), polycarbonate, polysaccharide, aliphatic polyketone, blue dextran, and cellophane. The said oxygen barrier layer would preferably be located in the sheet structure at the interface between the said biaxially oriented polyolefin sheet and the adhesive layer which attaches the sheet to the said photographic support. This location would have minimal effect on the overall image quality while positively impacting image stability. Two preferred barrier layer materials for this structure are 1) an aliphatic polyketone polymer and 2) a copolymer of vinyl alcohol and ethylene whereby the second is most preferred because they are low in cost and effective oxygen barriers. These materials possess very low oxygen transmission rates and can be extruded through multilayer coextrusion equipment with minimal modifications to the process. The thickness of the oxygen barrier layer of this invention is not critical, provided that the oxygen permeability is not more than 8.0 cc/$m^{2.}$ hr. atm. oxygen transmission rate, and more preferably not more than 2.0 $m^{2.}$ hr. atm. oxygen transmission rate, as this level appears to provide a good balance between material cost and benefits of use. In Example 1 below, this preferred barrier layer material for this structure of copolymer of vinyl alcohol and ethylene is incorporated into the biaxially oriented polyolefin sheet prior to orientation through coextrusion. By incorporating the oxygen transmission barrier layer in the structure prior to orientation, less material is necessary, as the act of biaxially orienting the barrier material further increases its barrier properties. In order to adhere the copolymer of vinyl alcohol and ethylene to the rest of the sheet structure, a coextrudable adhesive resin was used. These coextrudable adhesive resins cover a wide range of chemistries, and rheologies and are commonly used in the food packaging industry in conjunction with copolymers of vinyl alcohol and ethylene. They are based on ethylene vinyl acetate, polyethylene, polypropylene, acid copolymers, and ethylene/acrylate copolymers that are then processed with reactive monomers that covalently or ionically bond to various substrates. They are designed to promote adhesion between polymer layers while the polymers are in their molten state within the extrusion die and are readily available on the market, for example, under the trade name of 'Bynel' (produced by DuPont Co.).

The biaxially oriented composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability, coating polyvinylidene chloride for heat seal properties. Further examples include flame, plasma, or corona discharge treatment to improve printability or adhesion.

A second preferred embodiment of the invention is where an oxygen barrier layer having less than 8.0 cc/$m^{2.}$ hr. atm. oxygen transmission rate is applied as a post extrusion coated layer onto the said polyolefin sheet either before or after biaxial orientation. This post extrusion layer comprises at least one member selected from the group consisting of polyvinyl alcohols, polyvinylidene chlorides, aliphatic polyketones, chemically hardened gelatin, and mixtures thereof. Liquid coating methods which can be used according to the invention include a method in which a polymer is dissolved in water or an organic solvent, uniformly coated on the polyolefin sheet, either before or after biaxial orientation, and dried by hot air, and a method in which a polymer emulsion is coated and then dried. These application techniques are generally known in the industry. In the preferred form, the post extrusion layer comprises a layer of polyvinyl alcohol which is applied to the sheet as an aqueous coating after biaxial orientation—see Example 2. Aqueous coated polyvinyl alcohol has a very low oxygen transmission rate and can be produced to have no detrimental effect on silver halide imaging technology.

The structure of a typical biaxially oriented sheet of the invention is as follows:

| Embodiment 1 | Embodiment 2 | Embodiment 3 (see below) |
|---|---|---|
| Solid top skin layer | Solid top skin layer | Solid top skin layer |
| Voided core layer | Voided core layer | Voided core layer |
| Solid skin layer | Solid skin layer | Solid skin layer |
| Coextrudable Adhesive Layer | Aqueous Coated PVOH Layer | |
| Copolymer of Vinyl Alcohol and Ethylene | | |

The sheet on the side of the base paper opposite to the emulsion layers may be any suitable sheet. The sheet may or may not be microvoided. It may have the same composition as the sheet on the top side of the paper backing material. Biaxially oriented polyolefin sheets are conveniently manufactured by coextrusion of the sheet, which may contain several layers, followed by biaxial orientation. Such biaxially oriented polyolefin sheets are disclosed in, for example, U.S. Pat. No. 4,764,425.

The preferred biaxially oriented sheet is a biaxially oriented polyolefin sheet, most preferably a sheet of polyethylene or polypropylene. The thickness of the biaxially oriented polyolefin sheet should be from 10 to 150 $\mu$m. Below 15 $\mu$m, the sheets may not be thick enough to minimize any inherent non-planarity in the support and would be more difficult to manufacture. At thicknesses higher than 70 $\mu$m, little improvement in either surface smoothness or mechanical properties are seen, and so there is little justification for the further increase in cost for extra materials.

Suitable classes of thermoplastic polymers for the biaxially oriented polyolefin sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene, and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. Nos. 2,465,319 and U.S. Pat. No. 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented polyolefin sheet on the backside of the laminated base can be made with layers of the same polymeric material, or it can be made with layers of different polymeric composition. For compatibility, an auxiliary layer can be used to promote adhesion of multiple layers.

Addenda may be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented polyolefin sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers, while restraining to some degree the sheet against retraction in both directions of stretching.

The biaxially oriented polyolefin sheet on the backside of the laminated base, while described as having preferably at least one layer, may also be provided with additional layers that may serve to change the properties of the biaxially oriented polyolefin sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented polyolefin sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

The structure of a typical biaxially oriented polyolefin sheet that may be laminated to the opposite side of the imaging elements is as follows:

treated skin layer solid core layer

The support to which the microvoided composite sheets and biaxially oriented polyolefin sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephthalate such as disclosed in U.S. Pat. Nos. 4,912,333; 4,994,312; and 5,055,371.

The adhesive layer of this invention may be applied as a multiple step process whereby the adhesive polymer(s) are applied to one or both surfaces to be adhered, or more preferably applied as an extrusion coated lamination process, as this can be carried out in a single step. This preferred process involves melt extruding one or more layers through a T slot or a coat hanger die. The melt temperature of the preferred bonding agent is 240° C. to 325° C. Monofilm extrusion involves only one extruder pumping molten polymer out through a die, while coextrusion is a process that provides for more than one extruder to simultaneously pump molten polymer out through a die in simultaneous, yet discrete layers. Coextrusion is accomplished typically through the use of a multimanifold feedblock which serves to collect the hot polymer keeping the layers separated until the entrance to the die where the discrete layers are pushed out between the sheet and paper to adhere them together. Both monofilm and coextrusion lamination are carried out by bringing together the biaxially oriented polyolefin sheet and the base paper with application of the bonding agent between the base paper and the biaxially oriented polyolefin sheet followed by their being pressed together in a nip such as between two rollers.

The total thickness of the adhesive bonding layer adjacent to cellulose paper can range from 0.5 $\mu$m to 25 $\mu$m, preferably from 1 $\mu$m to 12 $\mu$m. Below 1 $\mu$m it is difficult to maintain a consistent melt extruded bonding layer thickness. At thickness higher than 12 $\mu$m, there is little improvement in biaxially oriented polyolefin sheet adhesion to paper.

In the preferred process, the bonding agent used for bonding biaxially oriented polyolefin sheets to either the top side or bottom side of cellulose photographic paper is preferably selected from a group of resins that can be melt extruded at about 160° C. to 300° C. Usually, a polyolefin resin such as polyethylene or polypropylene is used.

Adhesive resins preferred for bonding biaxially oriented polyolefin sheets to photographic grade cellulose paper are polyethylene. An adhesive resin used in this invention is one that can be melt extruded and provide sufficient bond strength between the cellulose paper and the biaxially oriented polyolefin sheet. For use in the conventional photographic system, peel forces between the paper and the biaxially oriented polyolefin sheets need to be greater than 150 grams/5 cm to prevent delamination during the manufacture of the photographic base, during processing of an image or in the final image format. "Peel strength" or "separation force" or "peel force" or "bond strength" is the measure of the amount of force required to separate the biaxially oriented polyolefin sheets from the base paper. Peel strength is measured using an Instron gauge and the 180-degree peel test with a cross head speed of 1.0 meters/min. The sample width is 5 cm and the distance peeled is 10 cm.

One or more adhesive layers may bond the said biaxially oriented polyolefin sheets to said base paper. In the case of a melt extruded single layer for bonding biaxially oriented polyolefin sheets to paper, the adhesive resin must adequately bond to both the paper and the biaxially oriented polyolefin sheets. In the case of multilayer extrusion, two or more resin layers allow for different adhesive resin materials to be used, thus allowing for optimization of adhesion between the adhesive resin and biaxially oriented polyolefin sheets and the adhesive resin and the base paper. The structure of embodiments one and two of this invention are as follows for both single layer and typical multilayer adhesive resin system between biaxially oriented polyolefin sheets and suitable photographic base paper:

| Embodiment 1 | Embodiment 2 |
|---|---|
| biaxially oriented polyolefin sheet<br>with incorporated oxygen barrier<br>Single layer adhesive resin<br>photographic base paper | biaxially oriented polyolefin sheet<br>with incorporated oxygen barrier<br>#1 adhesive resin<br>#2 adhesive resin<br>photographic base paper |

In embodiment 3 of the invention, an oxygen barrier layer having less than 8.0 cc/m$^2$ hr. atm. oxygen transmission rate is incorporated as a layer in the adhesive tie layer which attaches the said biaxially oriented polyolefin sheet to the photographic base. Said oxygen impermeable layer comprises at least one member selected from the group consisting of homo- and co-polymers of acrylonitrile, alkyl acrylates such as methyl acrylate, ethyl acrylate, butyl acrylate, alkyl methacrylates such as ethyl methacrylate and methyl methacrylate, methacrylonitrile, alkyl vinyl esters such as vinyl acetate, vinyl propionate, vinyl ethyl butyrate and vinyl phenyl acetate, alkyl vinyl ethers such as methyl vinyl ether, butyl vinyl ether, chloroethyl vinyl ether, vinyl alcohol, vinyl chloride, vinylidene chloride, vinyl floride, styrene and vinyl acetate (in the case of copolymers, ethylene and/or propylene can be used as comonomers), cellulose acetates such as diacetyl cellulose and triacetyl cellulose, polyesters such as polyethylene terephthalate, a fluorine resin, polyamide (nylon), polycarbonate, polysaccharide, aliphatic polyketone, blue dextrann and cellophane. The said oxygen barrier layer would preferably be located in a discrete layer sandwiched between two coextruded tie layers as in Example 3, as it is easier to process in this configuration, although it may also be applied as a monofilm layer adhering the sheet to the base. Two preferred barrier layer materials for this structure are 1) an aliphatic polyketone polymer and 2) a copolymer of vinyl alcohol and ethylene whereby the second is most preferred. These materials possess very low oxygen transmission rates and can be extruded through multilayer coextrusion equipment with minimal modifications to the process. The thickness of the oxygen barrier layer of this invention is not critical, provided that the oxygen permeability is not more than 8.0 cc/m$^2$ hr. atm. oxygen transmission rate, and more preferably not more than 2.0 cc/m$^2$ hr. atm. oxygen transmission rate for optimal balance of cost and effectiveness.

| Embodiment 3 | Preferred Embodiment 3 |
|---|---|
| biaxially oriented polyolefin sheet<br>Oxygen barrier adhesive resin<br>photographic base paper | biaxially oriented polyolefin sheet<br>#1 adhesive resin<br>Oxygen barrier adhesive resin<br>#2 adhesive resin<br>photographic base paper |

In the case of a silver halide photographic system, suitable adhesive resins must also not interact with the light sensitive emulsion layer. Preferred examples of adhesive resins are ionomer (e.g. an ethylene metharylic acid copolymer cross-linked by metal ions such as Na ions or Zn ions), ethylene vinyl acetate copolymer, ethylene methyl methacrylate copolymer, ethylene ethyl acrylate copolymer, ethylene methyl acrylate copolymer, ethylene acrylic acid copolymer, ethylene ethyl acrylate maleic anhydride copolymer, ethylene methacrylic acid copolymer, anhydride modified ethylene vinyl acetate, anhydride modified polyethylene, anhydride modified polypropylene, anhydride modified acid copolymers, anhydride modified ethylene acrylate copolymers, acid acrylate modified ethylene vinyl acetate, acid acrylate modified polyethylene, acid acrylate modified polypropylene, acid acrylate modified acid copolymers, acid acrylate modified ethylene acrylate copolymers, acid modified ethylene vinyl acetate, acid modified polyethylene, acid modified polypropylene, acid modified acid copolymers, or acid modified ethylene acrylate copolymers. These adhesive resins are preferred because they can be easily melt extruded and provide peel forces between biaxially oriented polyolefin sheets and base paper greater than 150 grams/5cm at machine speeds greater than 400 m/min.

Metallocene catalyzed polyolefin plastomers are most preferred for bonding to oriented polyolefin sheets because they offer a combination of excellent adhesion to smooth biaxially oriented polyolefin sheets, are easily melt extruded using conventional coextrusion equipment, and are low in cost when compared to other adhesive resins. Metallocenes are a class of highly active catalysts that are used in the preparation of polyolefin plastomers. These catalysts, particularly those based on group IVB transition metals such as zirconium, titanium, and hafnium, show extremely high activity in ethylene polymerization. Various forms of the catalyst system of the metallocene type may be used for polymerization to prepare the polymers used for bonding biaxially oriented polyolefin sheets to cellulose paper. Forms of the catalyst system include, but are not limited to, those of homogeneous, supported catalyst type, high pressure process or a slurry or a solution polymerization process. The metallocene catalysts are also highly flexible in that, by manipulation of catalyst composition and reaction conditions, they can be made to provide polyolefins with controllable molecular weights. Suitable polyolefins include polypropylene, polyethylene, polymethylpentene, polystyrene, polybutylene, and mixtures thereof. Development of these metallocene catalysts for the polymerization of ethylene is found in U.S. Pat. No. 4,937,299 (Ewen et al.).

The most preferred metallocene catalyzed copolymers are very low density polyethylene (VLDPE) copolymers of ethylene and a $C_4$ to $C_{10}$ alpha monolefin, most preferably copolymers and terpolymers of ethylene and butene-1 and hexene-1. The melt index of the metallocene catalyzed ethylene plastomers preferably fall in a range of 2.5 g/10 min to 27 g/10 min. The density of the metallocene catalyzed ethylene plastomers preferably falls in a range of 0.8800 to 0.9100. Metallocene catalyzed ethylene plastomers with a density greater than 0.9200 do not provide sufficient adhesion to biaxially oriented polyolefin sheets.

Melt extruding metallocene catalyzed ethylene plastomers presents some processing problems. Processing results from earlier testing in food packaging applications indicated that their coating performance, as measured by the neck-in to draw-down performance balance, was worse than conventional low density polyethylene making the use of metallocene catalyzed plastomers difficult in a single layer melt extrusion process that is typical for the production of current photographic support. By blending low density polyethylene with the metallocene catalyzed ethylene plastomer, acceptable melt extrusion coating performance was obtained making the use of metallocene catalyzed plastomers blended with low density polyethylene (LDPE) very efficient. The preferred level of low density polyethylene to be added is dependent on the properties of the LDPE used (properties such as melt index, density, and type of long chain branching) and the properties of the metallocene catalyzed ethylene plastomer selected. Since metallocene catalyzed ethylene plastomers are more expensive than LDPE, a cost to benefit trade-off is necessary to balance material cost with processing advantages such as neck-in and product advantages such as biaxially oriented film adhesion to paper. In general the preferred range of LDPE blended is 10% to 80% by weight.

Anhydride modified ethylene acrylate is most preferred for bonding to photographic grade cellulose paper because it offers a combination of excellent adhesion to cellulose paper and is easily melt coextruded using conventional extrusion equipment and is low in cost when compared to other adhesive resins.

The bonding layers may also contain pigments which are known to improve the imaging responses such as whiteness or sharpness. Pigments such as talc, kaolin, $CaCO_3$, $BaSO_4$, ZnO, $TiO_2$, ZnS, and $MgCO_3$ can be used to improve imaging responses. Titanium dioxide is preferred and is used in this invention to improve image sharpness. The $TiO_2$ used may be either anatase or rutile type. In the case of whiteness, anatase is the preferred type. In the case of sharpness, rutile is the preferred. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$.

As used herein the phrase "imaging element" is a material that may be used as a laminated support for the transfer of images to the support by techniques such as ink jet printing or thermal dye transfer, as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubooctahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent No. 789,823. Specific examples of reduction sensitizers or conditions, such as dimethylamineborane, stannous chloride, hydrazine, high pH (pH 8–11), and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1996, Item 38957, Section I, published by Kenneth Mason Publications, Ltd., Dudley Annex, 1 2a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 mm.

In the following Table, reference will be made to (1) *Research Disclosure*, December 1978, Item 17643, (2) *Research Disclosure*, December 1989, Item 308119, and (3) *Research Disclosure*, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing, and manipulating the elements and the images contained therein.

| Reference | Section | Subject Matter |
|---|---|---|
| 1 | I, II | Grain composition, |
| 2 | I, II, IX, X, XI, XII, XIV, XV, I, II, III, IX | morphology and preparation. Emulsion preparation including hardeners, coating |
| 3 | A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | |
| 2 | VI | Antifoggants and stabilizers |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | |
| 2 | XVII | Supports |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which compass the ultraviolet, visible, and infrared regions of the electromagnetic spectrum, as well as with electron beam, beta radiation, gamma radiation, x-ray, alpha particle, neutron radiation, and other forms of corpuscular and wave-like radiant energy in either non-coherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4TM (Eastman Kodak Company) Process or other processing systems suitable for developing high chloride emulsions.

The laminated substrate of the invention may have copy restriction features incorporated such as disclosed in U.S. application Ser. No. 08/598,785 filed Feb. 8, 1996 and U.S. application Ser. No. 08/598,778 filed on the same day. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the backside to enable users or machines to read and identify the media. The media may take the form of sheets that are capable of bearing an image. Typical of such materials are photographic paper and film materials composed of polyethylene resin coated paper, polyester, (poly)ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal, spatial, and spectral exposure of the photosensitive materials to visible or non-visible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in *Research Disclosure* 37038 of February 1995.

The following examples illustrate the practice of this invention.

They are not intended to be exhaustive of all possible variations of the invention. Parts and percentages are by weight unless otherwise indicated.

EXAMPLES

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

Emulsion Coating Format of Examples

| | Coating Format* | Laydown mg/m$^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | $SiO_2$ | 200 |
| | Surfactant | 2 |

*See Appendix for structures

EXAMPLES

An Embodiment 1 style oxygen barrier laminated photographic base was prepared by extrusion laminating the following sheets to both the top and bottom sides of a photographic grade of cellulose paper support:

Top Sheet: (Emulsion side)

A composite sheet (48 $\mu$m thick) with a density of 0.75 g/cc consisting of a microvoided and biaxially oriented polypropylene core (approximately 70% of the total sheet thickness) in which the void initiating material is poly butylene terephthalate, with a $TiO_2$ pigmented non-voided layer of polypropylene of approximately 12 $\mu$m on the emulsion side and a solid layer of polypropylene blended with maleic anhydride—for adhesion enhancement to a 2.5 μm layer of ethylene vinyl alcohol (@ 32% $C_2$) on the paper side.

In addition there is a thin skin layer of polyethylene on top of the $TiO_2$ layer to provide improved adhesion of the photographic emulsion to the support.

Bottom Side (Side opposite to the emulsion)

A sheet of BICOR 70 MLT (Mobil Chemical Co.) which is a one-side matte finished, one-side treated polypropylene sheet (18 μm thick) (d=0.9 g/cc) consisting of a solid oriented polypropylene core and a layer which is a mixture of polyethylenes and a terpolymer of ethylene-propylene-butylene. The matte finish side is towards the back of the element after bonding.

The biaxially oriented polyolefin sheets were extrusion laminated to each side of a photographic paper base with a layer of 9.8 g/$m^2$ of a blend of extrusion grade low density polyethylene with a density of 0.923 g/$cm^3$ and melt index of 4.2 and a metallocene catalyzed ethylene plastomer with a density of 0.900 g/$cm^3$ and melt index of 16.5.

The support structure of this example is as follows:

Composite Emulsion Side Sheet including 2.5 micron EVOH

Adhesion Layer

Photographic Paper

Adhesion Layer

BICOR 70 MLT

An Embodiment 2 style oxygen barrier laminated photographic base was prepared by extrusion laminating the following sheets to both the top and bottom sides of a photographic grade of cellulose paper support:

Top Sheet: (Emulsion side)

A composite sheet (38 μm thick) with a density of 0.75 g/cc consisting of a microvoided and biaxially oriented polypropylene core (approximately 70% of the total sheet thickness) in which the void initiating material is poly butylene terephthalate, with a $TiO_2$ pigmented non-voided layer on the emulsion side and layer of solid non-pigmented polypropylene on the paper side. In addition, there is a thin skin layer of polyethylene on top of the $TiO_2$ layer to provide improved adhesion of the photographic emulsion to the support.

This said composite sheet was then prepared by applying a primer layer to promote adhesion and a layer of polyvinyl alcohol with an approximate coverage of 0.62–0.93 grams/$m^2$. The polyvinyl alcohol was a fully hydrolyzed material.

Bottom Side (Side opposite to the emulsion)

A sheet of BICOR 70 MLT (Mobil Chemical Co.) which is a one-side matte finished, one-side treated polypropylene sheet (18 μm thick) (d=0.9 g/cc) consisting of a solid oriented polypropylene core. The matte finish side is towards the back of the element after bonding.

The biaxially oriented polyolefin sheets were extrusion laminated to each side of a photographic paper base with a layer of 9.8g/$m^2$ of a blend of extrusion grade low density polyethylene with a density of 0.923 g/$cm^3$ and melt index of 4.2 and a metallocene catalyzed ethylene plastomer with a density of 0.900 g/$cm^3$ and melt index of 16.5.

The support structure of this example is as follows:

Composite Emulsion Side Sheet

PVOH coating

Adhesion Layer

Photographic Paper

Adhesion Layer

BICOR 70 MLT

Example 3

An Embodiment 3 style oxygen barrier laminated photographic base was prepared by extrusion laminating the following sheets to both the top and bottom sides of a photographic grade of cellulose paper support:

Top Sheet: (Emulsion side)

A composite sheet (38 μm thick) with a density of 0.75 g/cc consisting of a microvoided and biaxially oriented polypropylene core (approximately 70% of the total sheet thickness) in which the void initiating material is poly butylene terephthalate, with a $TiO_2$ pigmented non-voided layer on the emulsion side and layer of solid non pigmented polypropylene on the paper side. In addition, there is a thin skin layer of polyethylene on top of the $TiO_2$ layer to provide improved adhesion of the photographic emulsion to the support.

Bottom Side (Side opposite to the emulsion)

A sheet of BICOR 70 MLT (Mobil Chemical Co.) which is a one-side matte finished (18 μm thick) (d=0.9 g/cc) having a solid oriented polypropylene layer. The matte finish side is a skin layer towards the back of the element after bonding to the base paper. The skin layer comprises a mixture of polyethylenes and a terpolymer of ethylene-propylene-butylene.

The biaxially oriented polyolefin sheets were extrusion laminated to each side of a photographic paper base with a 3 layer adhesive coextrusion coating. The coating consisted of two 2.5 μm layers of 80% DuPont Bynel 2169 anhydrive-modified ethylene acrylate coextrudable adhesive and 20% Eastman Chemical D4039P LDPE resin (low density polyethylene) sandwiching a 10 μm layer of 32% ethylene content EVAL EVOH copolymer of ethylene and vinyl alcohol from Eval Company of America.

The support structure of this example is as follows:

biaxially oriented polyolefin sheet

Bynel/LDPE adhesive resin

EVOH

Bynel/LDPE adhesive resin photographic base paper

Control

A control sample was prepared by the same technique of extrusion laminating the following sheets to both the top and bottom sides of a photographic grade of cellulose paper support:

Top Sheet: (Emulsion side)

A composite sheet (38 μm thick) with a density of 0.75 g/cc consisting of a microvoided and biaxially oriented polypropylene core (approximately 70% of the total sheet thickness) in which the void initiating material is poly butylene terephthalate, with a $TiO_2$ pigmented non-voided layer on the emulsion side and layer of solid non pigmented polypropylene on the paper side. In addition, there is a thin skin layer of polyethylene on top of the $TiO_2$ layer to provide improved adhesion of the photographic emulsion to the support.

Bottom Side (Side opposite to the emulsion)

A sheet of BICOR 70 MLT (Mobil Chemical Co.) which is a one-side matte finished, polypropylene sheet (18 μm thick) (d=0.9 g/cc) consisting of a solid oriented polypropylene layer and a skin layer. The matte finish skin side is anhydride-modified ethylene acrylate towards the back of the element after bonding.

The biaxially oriented polyolefin sheets were extrusion laminated to each side of a photographic paper base with a layer of 9.8g/$m^2$ of a blend of extrusion grade low density polyethylene with a density of 0.923 g/$cm^3$ and melt index of 4.2 and a metallocene catalyzed ethylene plastomer with a density of 0.900 g/cm$^3$ and melt index of 16.5.

The support structure of the control is as follows:

biaxially oriented polyolefin sheet

Adhesion Layer photographic base paper

All samples were then emulsion coated with the emulsion coating format listed above, and then exposed and processed to provide magenta dye density of 1.0. Sample strips were then placed into an Atlas weatherometer under 50K lux light exposure for 5 weeks. Magenta dye density was then measured at 5 weeks, and percent change from the initial density was calculated.

Results:

| Sample | OTR (cc/m$^2$ hr atm) | % Magenta Density Change (5 weeks) |
|---|---|---|
| Embodiment 1 example | <1.0 | −46.5 |
| Embodiment 2 example | <0.2 | −49.5 |
| Embodiment 3 example | <2.0 | −52.0 |
| Control | >100.0 | −61.5 |

These results show that the examples of each of the three embodiments of the invention all show significant improvement in fading properties of the magenta dye due to high intensity light over the control sample.

APPENDIX

Y-1

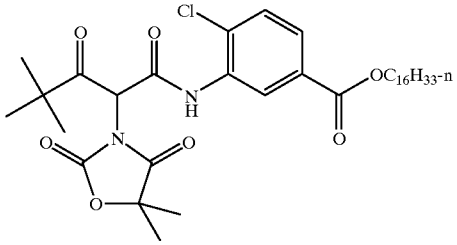

ST-1N-tert-butylacrylamide/n-butyl acrylate copolymer (50:50)

S-1=dibutyl phthalate

SC-1

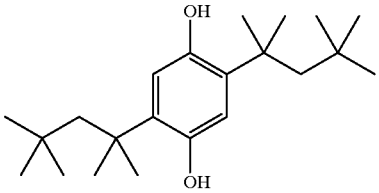

M-1

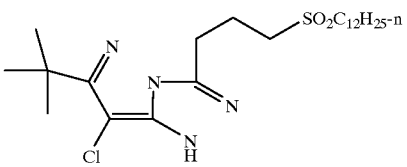

S-2 = diundecyl phthalate

-continued

ST-2

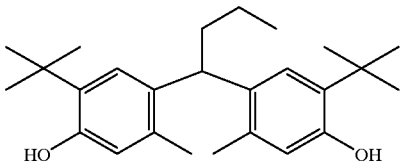

ST-3

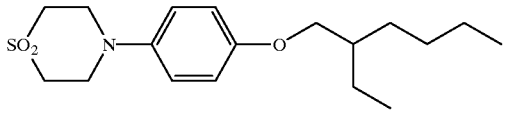

ST-4

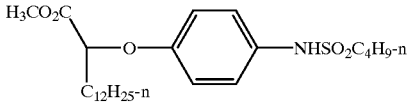

UV-1

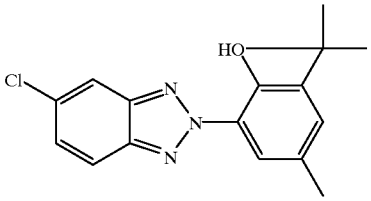

UV-2

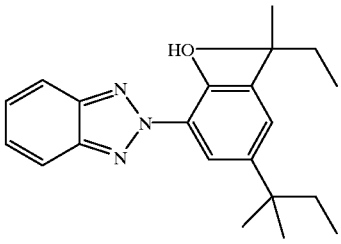

S-3=1,4-Cyclohexyldimethylene bis(2-ethylhexanoate)

C-1

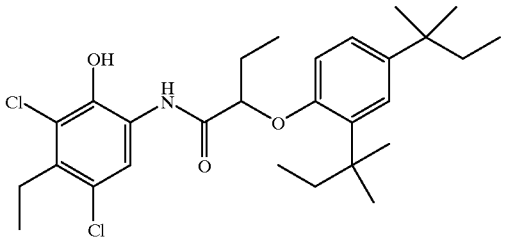

S-4=2-(2-Butoxyethoxy)ethyl acetate

Dye 1

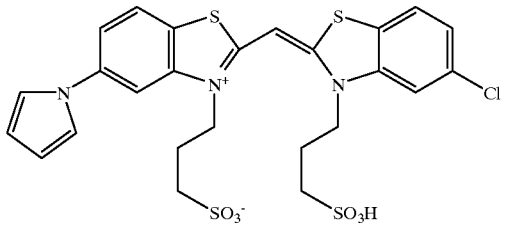

The invention has been described in detail with particular reference to certain preferred embodiments thereof, but it will be understood that variations and modifications can be effected within the spirit and scope of the invention.

What is claimed is:

1. An imaging element comprising paper and a biaxially oriented polyolefin sheet adhered to the upper side of said paper, wherein between the paper and the upper surface layer of said biaxially oriented polyolefin sheet, there is located at least one oxygen barrier layer having less than 8.0 $cc/m^{2\cdot}$ hr. atm. oxygen transmission rate wherein said at least one oxygen barrier layer comprises at least one layer of said biaxially oriented polyolefin sheet.

2. The imaging element of claim 1 wherein said oxygen transmission rate is less than 2.0 $cc/m^{2\cdot}$ hr. atm.

3. The imaging element of claim 1 wherein said at least one oxygen barrier layer is located between the paper and a voided layer of said biaxially oriented polyolefin sheet.

4. The imaging element of claim 1 wherein said at least one layer comprises a layer of a copolymer of ethylene and vinyl alcohol.

5. The imaging element of claim 1 wherein said at least one layer comprises a layer of an aliphatic polyketone polymer.

6. The imaging element of claim 1 wherein said biaxially oriented polyolefin sheet comprises a five layer biaxially oriented, microvoided polyolefin sheet with a 1.0 $\mu$m skin layer comprising polyethylene.

7. The imaging element of claim 1 further comprising silver halide photosensitive imaging layers.

* * * * *